United States Patent [19]

Yano et al.

[11] 4,197,813

[45] Apr. 15, 1980

[54] MAGNETIC BRUSH DEVELOPMENT APPARATUS WITH DEVELOPER SUPPLY DETECTING MEANS

[75] Inventors: Takashi Yano; Mitsuo Shibusawa, both of Tokyo, Japan

[73] Assignee: Ricoh Company, Ltd., Tokyo, Japan

[21] Appl. No.: 964,887

[22] Filed: Nov. 30, 1978

[30] Foreign Application Priority Data

Nov. 30, 1977 [JP] Japan ..... 52-144482

[51] Int. Cl.[2] ..... G03G 15/09

[52] U.S. Cl. ..... 118/694; 118/691; 222/DIG. 1; 222/65; 430/122

[58] Field of Search ..... 427/18; 118/691, 668, 118/671, 694, 668; 222/DIG. 1, 64, 65, 23

[56] References Cited

U.S. PATENT DOCUMENTS 3,765,654 10/1973 Rarey et al. ..... 118/691 X 3,872,825 3/1975 Davidson ..... 118/691

*Primary Examiner*—John D. Welsh

*Attorney, Agent, or Firm*—Cooper, Dunham, Clark, Griffin & Moran

[57] ABSTRACT

The magnetic brush development apparatus for developing a latent electrostatic image on a photoconductive material by a magnetic brush formed on a development sleeve comprises a hopper whose outlet for supplying one-component type magnetic developer to the development sleeve is positioned in proximity to the surface of the development sleeve, and a developer detecting apparatus comprising a light emitting element and a light receiving element is positioned in proximity to the outlet of the hopper and the surface of the development sleeve. The light emitting element and the light receiving element are positioned so as to hold therebetween a transparent container for allowing the developer to pass therethrough.

6 Claims, 4 Drawing Figures

MAGNETIC BRUSH DEVELOPMENT APPARATUS WITH DEVELOPER SUPPLY DETECTING MEANS

BACKGROUND OF THE INVENTION

The present invention relates to a magnetic brush development apparatus for use with an electrophotographic copying machine and an electrostatic recording apparatus.

The magnetic brush development apparatus is an apparatus of the type in which a magnetic developer is supplied to a development sleeve having a magnet therein and a magnetic brush is formed on the development sleeve, and by bringing the magnetic brush into contact with a latent electrostatic image formed on a photoconductor or a recording material, the latent electrostatic image is developed.

With respect to the supply of the developer to the development sleeve in the magnetic development apparatus, two types of the magnetic development apparatuses are known. In one type, the developer is supplied to the development sleeve from a hopper situated above or beside the development sleeve, and in the other type, the developer placed in a lower portion of the development apparatus is attracted to the development sleeve. In both types, the development sleeve transports the developer deposited on the surface of the development sleeve to the photoconductor or to the recording material, with the magnet disposed in the development sleeve or the development sleeve rotated.

As the magnetic developer, a one-component type developer and a two-component type developer are known. The one-component type developer comprises colored particles (toner) containing magnetic powders therein. The two-component type developer comprises magnetic particles called carriers and non-magnetic toner.

In either case, development is effected by the toner being attracted electrostatically to a latent electrostatic image formed on a photoconductor or the recording material. In the case of the two-component type developer, the toner is triboelectrically charged by the carriers to the polarity opposite to that of the latent electrostatic image. In the case of the one-component type developer, when the magnetic toner is low in resistivity, the toner is charged to the polarity opposite to that of a latent electrostatic image as the toner is brought to the latent electrostatic image, but when the magnetic toner is high in resistivity, the toner is triboelectrically charged to the polarity opposite to that of a latent electrostatic image within the container of the toner or while it is transported to the latent electrostatic image.

Since the one-component type magnetic developer does not contain carriers, the concentration control of the developer is unnecessary and the developer is not deteriorated by carriers. Therefore, handling of the one-component type developer is easy. However, when the developer runs out, the image density is reduced so quickly that it is necessary to detect the amount of the remaining developer before the developer runs out.

Conventionally, such detection of the remaining developer is performed by detecting the change of a leaked magnetic flux or the change of an inductance of the developer since they depend upon the quantity of the developer in a detecting portion.

However, the detecting efficiency of the above-mentioned methods is low and an expensive amplification circuit, a comprison circuit, a compensation circuit, and the other circuits are necessary. Furthermore, the above-mentioned methods are not stable in operation, and occasionally, the flow of the developer is hindered by a developer detecting means disposed in the development apparatus.

SUMMARY OF THE INVENTION

It is therefore an object of the present invention to provide a magnetic brush development apparatus having an improved detecting means for detecting the amount of the remaining developer.

In an embodiment of a magnetic brush development apparatus according to the present invention, an outlet of a hopper for supplying one-component type magnetic developer to a development sleeve is positioned in proximity to the surface of the development sleeve, and a developer detecting means for detecting the presence of the developer in the hopper, which comprises a light emitting element and a light receiving element and a transparent container for allowing the developer to pass therethrough disposed between the two elements, is also positioned in proximity to the outlet of the hopper and to the surface of the development sleeve.

BRIEF DESCRIPTION OF THE DRAWINGS

For a better understanding of the invention as well as other objects and further features thereof, reference is had to the following detailed description of the invention to be read in connection with the accompanying drawings, wherein.

DETAILED DESCRIPTION OF THE PREFERRED EMBODIMENT

Figure 1:
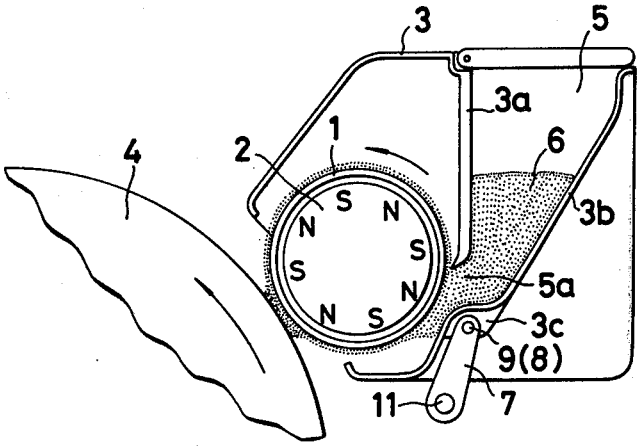
FIG. 1 is a schematic sectional view of an embodiment of a magnetic brush development apparatus according to the present invention.

Referring to FIG. 1, there is shown schematically an embodiment of a magnetic brush development apparatus according to the present invention. In the figure, a development sleeve 1 is made of a non-magnetic material, in which a magnet 2 having a plurality of magnetic poles is disposed. The development sleeve 1 is disposed in a housing 3 so as to be rotatable counterclockwise with a predetermined clearance between the surface of the development sleeve 1 and that of a photoconductor drum 4. The magnet 2 is stationary in the development sleeve 1. A partition plate 3*a* is disposed in the central portion of the housing 3, extending from the upper portion of the housing 3 and down to the right side of the development sleeve 1. The downmost portion of the partition plate 3 is bent towards the surface of the development sleeve 1 with a predetermined space therebetween. A hopper 5 is formed by the partition plate 3*a* and a back plate 3*b* of the housing 3, and one-component type magnetic developer 6 is held in the hopper 5. The magnetic developer 6 in the hopper 5 is supplied to the surface of the development sleeve 1 from a developer supply opening portion 5*a* formed by the downmost portion of the partition plate 3a and the back plate 3b.

Figure 2:
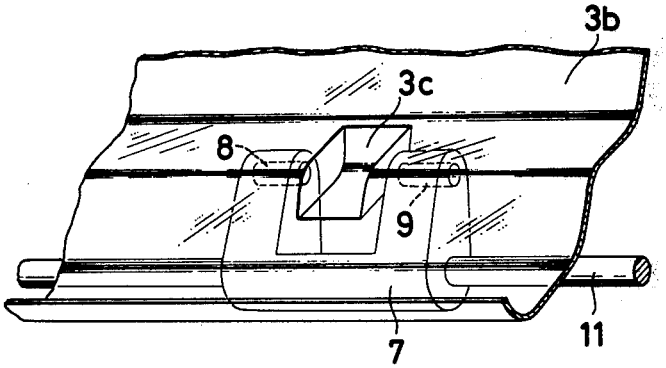
FIG. 2 is a partial perspective view of a back plate of a hopper of the magnetic brush development apparatus of FIG. 1.
Figure 3:
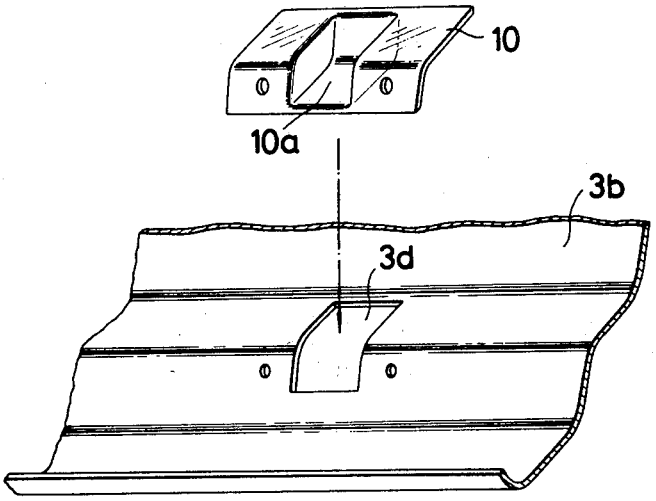
FIG. 3 is a perspective view of another example of the back plate for use in the magnetic brush development apparatus of FIG. 1.

The magnet 2 is disposed in the development sleeve 1 so that one magnetic pole thereof always faces the developer supply opening portion 5a. In a central portion of the back plate 3b, which is closest to the magnetic pole, there is formed a concave portion 3c as shown in FIG. 2. The opposite sides of the concave portion 3c are parallel to each other. A light emitting element 8 and a light receiving element 9, which are attached to an element bracket 7, are disposed so as to hold the concave portion 3c, facing each other from the opposite parallel sides of the concave portion 3c. For instance, the light emitting element 8 is an LED ($\lambda$=900nm), and the light receiving element 9 is a phototransistor. As the materials for use in the back plate 3b, such materials as are transparent with respect to the wavelength of the light from the light emitting element can be employed. For instance, glass, styrene resin, and polycarbonate resin methacrylate resin can be employed. It is not always necessary that the whole of the back plate 3b be made of such a material, but it is necessary that at least the concave portion 3c be made of such a material. Therefore, as shown in FIG. 3, the back plate 3b with a concave portion can be made as follows. A hole 3d is formed in the back plate 3b made of a material different from that of the concave portion. In the hole 3d, there is fitted a member 10 having a concave portion 10a made of any of the abovementioned transparent materials, and the member 10 is fastened to the back plate 3b by screws. In this case, the element bracket 7 is rockably mounted on a support shaft 11 for the purpose of easy maintenance of the light emitting element 8 and the light receiving element 9.

The developer 6 in the hopper 5 is supplied to the surface of the development sleeve 1 from the developer supply opening portion 5a a disposed at a lower portion of the hopper 5, and the developer 6 is attracted to the surface of the rotating development sleeve 1 by the magnetic attraction of the magnet 2 in the development sleeve 1, but the amount of the developer attracted to the development sleeve 1 is controlled by the edge of the partition plate 3a. The developer 6 on the development sleeve 1 is brought into contact with the surface of the photoconductor drum 4 where the development sleeve 1 comes closest to the photoconductor drum 4, so that a latent electrostatic image on the photoconductor drum 4 is developed.

When the amount of the developer 6 in the hopper 5 is decreased as the development is repeated, the developer 6 in the concave portion 3c of the back plate 3b is also attracted to the development sleeve 1 by the magnetic attraction of the magnetic pole in proximity to the concave portion 3c, so that the quantity of light received by the light receiving element 9 from the light emitting element 8 increases, resulting in the change of the electric current of the light receiving element 9. Thus, the quantity of the developer remaining in the hopper 5 is detected.

A feature of the present invention is in that the light emitting element 8 and the light receiving element 9 are disposed in proximity to the surface of the development sleeve 1 as well as to the developer supply opening portion 5a of the hopper 5. Therefore, the developer in proximity to the light emitting element 8 and to the light receiving element 9 is always attracted to the development sleeve 1 by the magnetic attraction of the magnet 2 disposed in the development sleeve 1, so that the lowering of detection efficiency and the malfunction of the light emitting element 8 and the light receiving element 9 can be obviated. In case the developer is detected from the outside of the concave portion 3c formed in the back plate 3b as shown in FIG. 2, the developer in the concave portion 3c is always attracted to the development sleeve 1, so that the lowering of detection efficiency and the mulfunction of the elements 8 and 9 are not caused by adhesion of the developer to the detecting portion of the concave portion 3c. When the development sleeve 1 and the magnet 2 are set so that the magnetic flux density on the surface of the development sleeve 1 near the magnetic pole of the magnet 2 is 1200 Gauss, and a developer prepared by the following procedure is employed, the attraction of the development sleeve 1 with respect to the developer reaches as far as about 24 mm from the surface of the development sleeve 1. Thirty-five (35) parts by weight of styrene resin (D 125 made by Esso Standard), 60 parts by weight of tri-iron tetoxide (made by Toda Kogyo Co., Ltd. 0.5 um), 5 parts by weight of carbon black (No. 44 Mitsubish Carobn Co., Ltd.) are mixed at a bout 150° C. for one hour in a heat application kneader and the mixture is rolled, cooled, ground and classified, and the developer whose particle size is in the range of about 10 to 25 $\mu$m is employed. In case the above developer is used under the above-mentioned condition, the light emitting element 8 and the light receiving element 9 are disposed with 24 mm away from the surface of the development sleeve 1.

Under the above-mentioned condition and by employing the above-mentioned development apparatus, a development experiment was conducted by setting the light emitting element 8 and the light receiving element 9 at a distance of 10 mm from the surface of the development sleeve 1. The lowering of detecting efficiency and the malfunction did not occur when the concave portion 3c was employed without being cleaned for a long period of time. After it was judged that no developer was left in the hopper from the fact that no developer was left in the concave portion 3c, it was possible to make 70 copies further from an A3 size original with a standard image density.

This indicates that in the case of the above construction, even if no developer is left in the concave portion 3c, some developer still remains at the supply opening portion 5a of the hopper 5. In this sense, the timing for detecting the remaining developer is appropriate.

Figure 4:
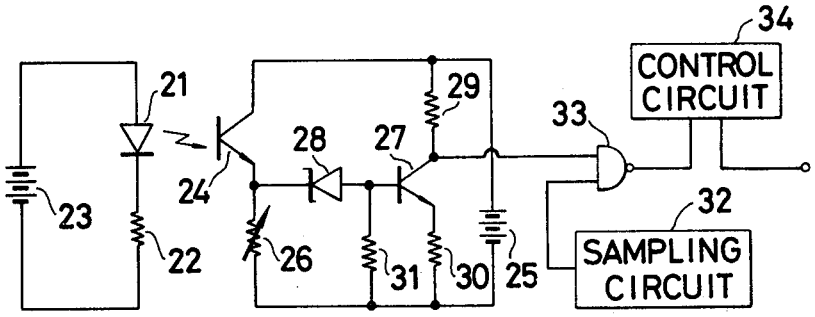
FIG. 4 is a block diagram of the developer detection circuits employed in the present invention.

Referring to FIG. 4, there are shown developer detection circuits employed in the magnetic brush development apparatus according to the present invention. In the circuits, a light emitting diode 21, a resistor 22 and a power source 23 are connected in series so as form a circuit. A light from the light emitting diode 21 is detected by a phototransistor of the other circuit. A collector electrode of the phototransistor 24 is connected to the positive pole side of the power source 25 and an emitter electrode of the phototransistor 24 is connected to a negative pole side of the power source 25 through a variable resistor 26. Between the emitter electrode of the phototransistor 24 and a base electrode of a transistor 27 for amplification, there is connected a zener diode 28. A collector electrode of the transistor 27 is connected to the positive pole side of the power source 25 through a resistor 29 and an emitter electrode of the transistor 27 is connected to the negative pole side of the power source 25 through a resistor 30. Between the base electrode of the transistor 27 and the negative pole side of the power source 25, there is connected a resistor 31.

The output of the transistor 27 is fed to a NAND circuit 33, together with the output from a sampling circuit 32, and an output is produced from a control circuit 34. As a final output, a display for requesting replenishment of the developer or termination of the sequence of the development apparatus or switching operation for exchanging a developer container can be employed.

In the above-mentioned embodiment of a magnetic brush development apparatus, the development sleeve 1 is rotated, while the magnet 2 disposed inside the development sleeve 1 is stationary. However, the present invention can be applied to a development apparatus of the type in which the development sleeve 1 is stationary, and to a development apparatus of the type in which both the development sleeve 1 and the magnet 2 are rotated.

Furthermore, in the above-mentioned embodiment, one development roller is employed. However, the present invention can be applied to a development apparatus of the type having two development rollers, a first roller for charging the developer and a second roller for performing development, by applying the present invention to the first roller.

What is claimed is:

1. In a magnetic brush development apparatus in which a latent electrostatic image formed on a photoconductive material is developed by a magnetic brush formed on a development sleeve having a magnet therein by supplying one-component type magnetic developer to said development sleeve, the improvement wherein an outlet of a hopper for supplying said developer to said development sleeve is positioned in proximity to the surface of said development sleeve, and a developer detecting means comprising a light emitting element and a light receiving element for detecting the presence of said developer in said hopper is positioned in proximity to said outlet of said hopper and the surface of said development sleeve.

2. A magnetic brush development apparatus as claimed in claim 1, wherein said developer detecting means comprises a container made of a transparent material capable of allowing said developer to pass therethrough, and said light emitting element and said light receiving element are respectively positioned across said container so as to face each other.

3. A magnetic brush development apparatus as claimed in claim 2, said container of said developer detecting means is formed in a part of a wall of said hopper.

4. A magnetic brush development apparatus as claimed in claim 2, wherein said light emitting element and said light receiving element are rockably supported on a bracket.

5. A magnetic brush development apparatus as claimed in claim 3, wherein said container is detachable from said wall of said hopper.

6. A magnetic brush development apparatus as claimed in claim 3, wherein said container is formed integrally with said wall of said hopper.

* * * * *